US010237677B1

(12) United States Patent
Matsumoto

(10) Patent No.: US 10,237,677 B1
(45) Date of Patent: Mar. 19, 2019

(54) AUDIO PROCESSING METHOD, AUDIO PROCESSING APPARATUS, AND NON-TRANSITORY COMPUTER-READABLE STORAGE MEDIUM FOR STORING AUDIO PROCESSING COMPUTER PROGRAM

(71) Applicant: FUJITSU LIMITED, Kawasaki-shi, Kanagawa (JP)

(72) Inventor: Chikako Matsumoto, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 16/139,208

(22) Filed: Sep. 24, 2018

(30) Foreign Application Priority Data

Sep. 28, 2017 (JP) ..... 2017-188419

(51) Int. Cl.
*H04S 7/00* (2006.01)
*H04R 25/00* (2006.01)

(52) U.S. Cl.
CPC ..... *H04S 7/302* (2013.01); *H04R 25/552* (2013.01); *H04S 7/307* (2013.01); *H04S 2400/11* (2013.01); *H04S 2420/01* (2013.01)

(58) Field of Classification Search
CPC combination set(s) only.
See application file for complete search history.

(56) References Cited

U.S. PATENT DOCUMENTS

2009/0046864 A1 2/2009 Mahabub et al.

FOREIGN PATENT DOCUMENTS

| | | |
|---|---|---|
| JP | 2003-348700 | 12/2003 |
| JP | 2010-041425 | 2/2010 |
| JP | 2013-211906 | 10/2013 |
| JP | 2015-130550 | 7/2015 |

*Primary Examiner* — Ping Lee
(74) *Attorney, Agent, or Firm* — Fujitsu Patent Center

(57) ABSTRACT

A method includes: acquiring a delay amount of a second transfer function relative to a first transfer function, the first and second transfer function indicating sound transfer characteristics in a head of a user for a first and second sound source direction; and calculating a value of a third transfer function regarding a third sound source direction at the elapsed time, by interpolating a first value and a second value based on a first angular difference and a second angular difference, the first value being a value of the first transfer function at the elapsed time, the second value being a value of the second transfer function at a time after the elapsed time, the first angular difference being between the third sound source direction and the first sound source direction, the second angular difference being between the third sound source direction and the second sound source direction.

12 Claims, 10 Drawing Sheets

FIG. 4

| T | m | n | $\Delta t_i$ | n |
|---|---|---|---|---|
| 4 | 4 | 10 | 6 | m0,n0 |
| 5 | | | 5 | |
| 6 | | | 5 | |
| 7 | | | 4 | |
| 8 | | | 4 | |
| 9 | | | 3 | |
| 10 | | | 3 | |
| 11 | | | 2 | |
| 12 | | | 2 | |
| 13 | | | 1 | |
| 14 | | | 1 | |
| 15 | 15 | 15 | 0 | m1,n1 |
| 16 | | | 2 | |
| 17 | | | 3 | |
| 18 | | | 5 | |
| 19 | | | 6 | |
| 20 | 20 | 28 | 8 | m2,n2 |
| 21 | | | 7 | |
| 22 | | | 7 | |
| 23 | | | 6 | |
| 24 | | | 6 | |
| 25 | | | 5 | |
| 26 | | | 4 | |
| 27 | | | 4 | |
| 28 | | | 3 | |
| 29 | | | 3 | |
| 30 | 30 | 32 | 2 | m3,n3 |
| 31 | | | 2 | |
| 32 | | | 2 | |
| 33 | | | 2 | |

400

FIG. 9

| T | m | n | t | Δ tmi | Δ tni | |
|---|---|---|---|---|---|---|
| 4 | | | | -3 | 3 | |
| 5 | | | | -3 | 3 | |
| 6 | | | | -3 | 3 | |
| 7 | 4 | 10 | 7 | -3 | 3 | m0,n0 |
| 8 | | | | -3 | 3 | |
| 9 | | | | -2 | 2 | |
| 10 | | | | -2 | 2 | |
| 11 | | | | -2 | 2 | |
| 12 | | | | -1 | 1 | |
| 13 | | | | -1 | 1 | |
| 14 | | | | 0 | 0 | |
| 15 | 15 | 15 | 15 | 0 | 0 | m1,n1 |
| 16 | | | | -1 | 1 | |
| 17 | | | | -1 | 1 | |
| 18 | | | | -2 | 2 | |
| 19 | | | | -2 | 2 | |
| 20 | | | | -3 | 3 | |
| 21 | | | | -3 | 3 | |
| 22 | | | | -4 | 4 | |
| 23 | | | | -4 | 4 | |
| 24 | 20 | 28 | 24 | -4 | 4 | m2,n2 |
| 25 | | | | -4 | 4 | |
| 26 | | | | -4 | 4 | |
| 27 | | | | -4 | 4 | |
| 28 | | | | -4 | 4 | |
| 29 | | | | -3 | 3 | |
| 30 | | | | -3 | 3 | |
| 31 | | | | -3 | 3 | |
| 32 | | | | -3 | 3 | |
| 33 | | | | -3 | 3 | |
| 34 | | | | -2 | 2 | |
| 35 | | | | -2 | 2 | |
| 36 | | | | -2 | 2 | |
| 37 | | | | -2 | 2 | |
| 38 | | | | -2 | 2 | |
| 39 | | | | -1 | 1 | |
| 40 | | | | -1 | 1 | |
| 41 | | | | -1 | 1 | |
| 42 | | | | -1 | 1 | |
| 43 | | | | -1 | 1 | |
| 44 | 43 | 45 | 44 | -1 | 1 | m3,n3 |

900

AUDIO PROCESSING METHOD, AUDIO PROCESSING APPARATUS, AND NON-TRANSITORY COMPUTER-READABLE STORAGE MEDIUM FOR STORING AUDIO PROCESSING COMPUTER PROGRAM

CROSS-REFERENCE TO RELATED APPLICATION

This application is based upon and claims the benefit of priority of the prior Japanese Patent Application No. 2017-188419, filed on Sep. 28, 2017, the entire contents of which are incorporated herein by reference.

FIELD

The embodiment discussed herein is related to an audio processing method for generating a binaural signal, an audio processing apparatus, and a non-transitory computer-readable storage medium for storing a audio processing program, for example.

BACKGROUND

As one of audio signals capable of enhancing a realistic feeling of a user, there has been known a binaural signal taking into account transfer characteristics of a sound in the head of the user. A binaural signal indicating a sound from a desired sound source direction is generated by a convolution operation of a head-related transfer function indicating the transfer characteristics of the sound in the head of the user and a monaural audio signal, according to the desired sound source direction, for example.

In order to generate a binaural signal for any sound source direction, it is preferable that head-related transfer functions are prepared beforehand for all sound source directions. However, it is actually not realistic in terms of cost and work effort to measure transfer characteristics of the head of the user for all the sound source directions and then generate head-related transfer functions for all the sound source directions based on the measurement result. Therefore, transfer characteristics of the head of the user are previously measured for some sound source directions, and head-related transfer functions are prepared for those sound source directions. Then, head-related transfer functions for the other sound source directions are obtained by interpolation based on the prepared head-related transfer functions. For example, there has been proposed a technique to obtain transfer characteristics in a desired sound source direction by delaying transfer characteristics by a delay amount in the desired sound source direction, the transfer characteristics being obtained by interpolating transfer characteristics with a delay amount removed therefrom for each of a plurality of sound source directions.

Examples of the related art include Japanese Laid-open Patent Publication No. 2010-41425.

SUMMARY

According to an aspect of the invention, an audio processing method comprising: executing a delay amount acquisition process that includes acquiring, for each of a plurality of elapsed times, a delay amount of a second head-related transfer function relative to a first head-related transfer function, the first head-related transfer function indicating sound transfer characteristics in a head of a user for a first sound source direction, the second head-related transfer function indicating sound transfer characteristics in the head of the user for a second sound source direction; and executing an interpolation process that includes calculating, for each of the plurality of elapsed times, a value of a third head-related transfer function at the elapsed time, by interpolating a first value and a second value based on a first angular difference and a second angular difference, the third head-related transfer function indicating sound transfer characteristics in the head of the user for a third sound source direction, the a first value being a value of the first head-related transfer function at the elapsed time, the second value being a value of the second head-related transfer function at a time delayed from the elapsed time by a delay amount corresponding to the elapsed time, the first angular difference being an angular difference between the third sound source direction and the first sound source direction, the second angular difference being an angular difference between the third sound source direction and the second sound source direction.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 4 is a diagram illustrating an example of a table illustrating a delay amount at each elapsed time, which is obtained from the feature point pairs illustrated in FIG. 3;

FIG. 9 is a diagram illustrating an example of a table illustrating the delay amount at each elapsed time, which is obtained from the feature point pairs illustrated in FIG. 8.

DESCRIPTION OF EMBODIMENT

In the conventional technique, when there is a significant difference in shape between transfer functions in a plurality of sound source directions used for interpolation, the transfer functions could sometimes cancel each other out at a certain elapsed time by interpolation. In such a case, a transfer function generated by interpolation has a value smaller than its normal value at the elapsed time. As a result, the transfer function generated by interpolation may no longer accurately express transfer characteristics of the head of a user. It is assumed, for example, that the transfer function interpolated by the above technique is used when a virtual position of a sound source that generates white noise is moved to generate a binaural signal from each virtual position. In this case, the continuity of amplitude is not maintained since the amplitude of a binaural signal in a sound source direction where inappropriate interpolation is performed becomes smaller than the amplitude of a binaural signal in an adjacent sound source direction.

According to an aspect of the present disclosure, there is provided a technique capable of appropriately generating a head-related transfer function in a sound source direction of interest based on head-related transfer functions in a plurality of sound source directions during audio processing.

Hereinafter, with reference to the drawings, description is given of an audio processing apparatus according to an embodiment.

The audio processing apparatus generates a head-related transfer function in a specified sound source direction by interpolation using two of head-related transfer functions in a plurality of sound source directions, which are previously prepared for a user. In this event, the audio processing apparatus calculates a delay amount of one of the two head-related transfer functions used for interpolation relative to the other, for each elapsed time since the start of a response. For each elapsed time, the audio processing apparatus specifies a value of one of the head-related transfer functions at the elapsed time, and also specifies a value of the other head-related transfer function delayed from the elapsed time by a corresponding delay amount. Then, the audio processing apparatus obtains the value of the head-related transfer function in the specified sound source direction at the elapsed time by interpolating the specified values of the two head-related transfer functions, for each elapsed time, based on angular differences between the specified sound source direction and the sound source directions used for interpolation.

This audio processing apparatus may be installed in various devices that generate or regenerate binaural signals, for example, a cell-phone, an audio system, a computer, and the like that may be connected to a headphone, an earphone or a speaker.

Figure 1:
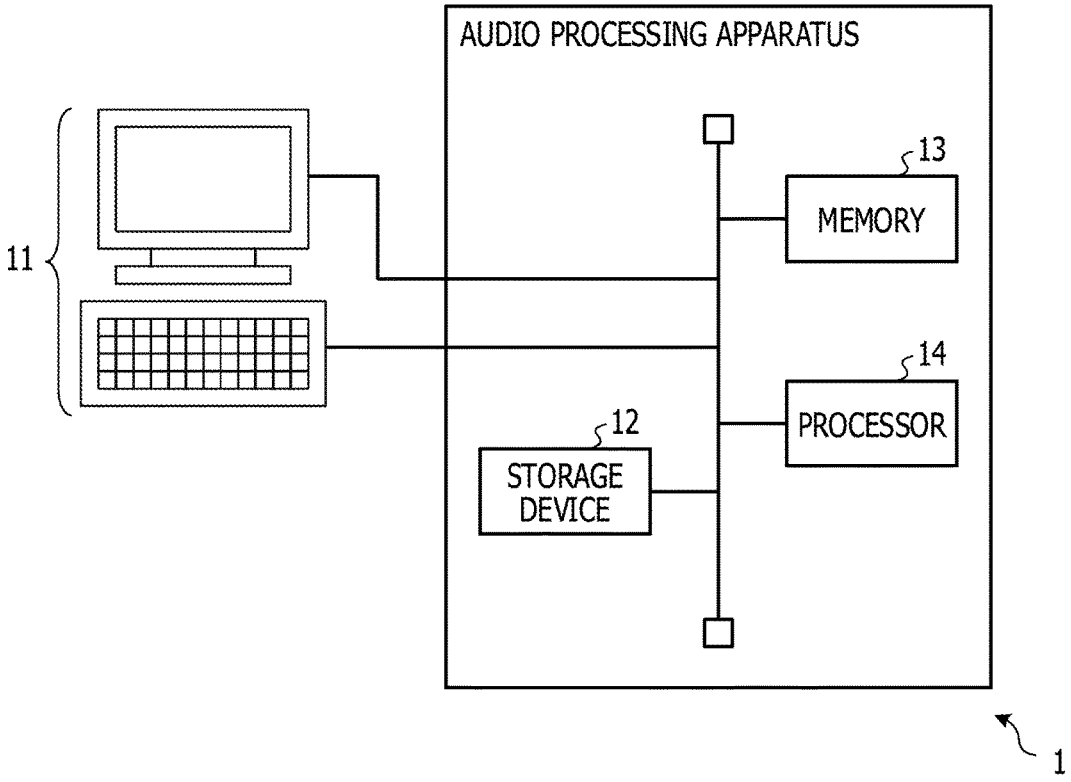
FIG. 1 is a schematic configuration diagram of an audio processing apparatus according to an embodiment.

FIG. 1 is a schematic configuration diagram of an audio processing apparatus according to an embodiment. An audio processing apparatus 1 includes a user interface 11, a storage device 12, a memory 13, and a processor 14. Note that the audio processing apparatus 1 may further include: an audio interface (not illustrated) for connecting to an audio output device such as a headphone, an earphone or a speaker; and a communication interface (not illustrated) for communicating with another device.

The user interface 11 includes, for example, an input device such as a keyboard and a mouse, and a display device such as a liquid crystal display. When a user performs an operation on the user interface 11 to specify a sound source direction for generating a binaural signal, for example, the user interface 11 generates an operation signal indicating the specified sound source direction and outputs the operation signal to the processor 14. Furthermore, when the user performs an operation on the user interface 11 to specify a monaural audio signal used to generate the binaural signal, the user interface 11 generates an operation signal indicating the specified monaural audio signal. Then, the user interface 11 outputs the operation signal to the processor 14.

The storage device 12 is an example of a storage unit, including a storage medium such as a magnetic disk, a semiconductor memory card, and an optical storage medium, for example, and a device that accesses such a storage medium. The storage device 12 stores head-related transfer functions for left and right ears of the user for more than one sound source direction, for example, every 30°. Each of the head-related transfer functions is represented as a value set at each sampling point for the elapsed time since a response start point, corresponding to a sampling frequency of 48 kHz, for example. Note that the sampling frequency is not limited to 48 kHz but may be 32 kHz, 64 kHz or 96 kHz, for example. Moreover, the storage device 12 may also store one or more monaural audio signals. Furthermore, the storage device 12 may also store the binaural signal for the specified sound source direction, which is generated by the processor 14.

The memory 13 is another example of the storage unit, including a readable and writable non-volatile semiconductor memory and a readable and writable volatile semiconductor memory, for example. The memory 13 stores various kinds of data used for audio processing executed on the processor 14 and various kinds of data generated in the course of the audio processing.

The processor 14 includes, for example, a central processing unit (CPU), a readable and writable memory circuit, and a peripheral circuit thereof. The processor 14 may further include a numerical operation circuit. The processor 14 generates a head-related transfer function for the specified sound source direction for each of the left and right ears of the user by interpolating the head-related transfer functions for two sound source directions among the head-related transfer functions for more than one sound source direction stored in the storage device 12. Furthermore, the processor 14 generates a binaural signal for the left ear of the user by performing a convolution operation of the specified monaural audio signal and the head-related transfer function for the left ear for the specified sound source direction. Likewise, the processor 14 generates a binaural signal for the right ear of the user by performing a convolution operation of the specified monaural audio signal and the head-related transfer function for the right ear for the specified sound source direction.

Figure 2:
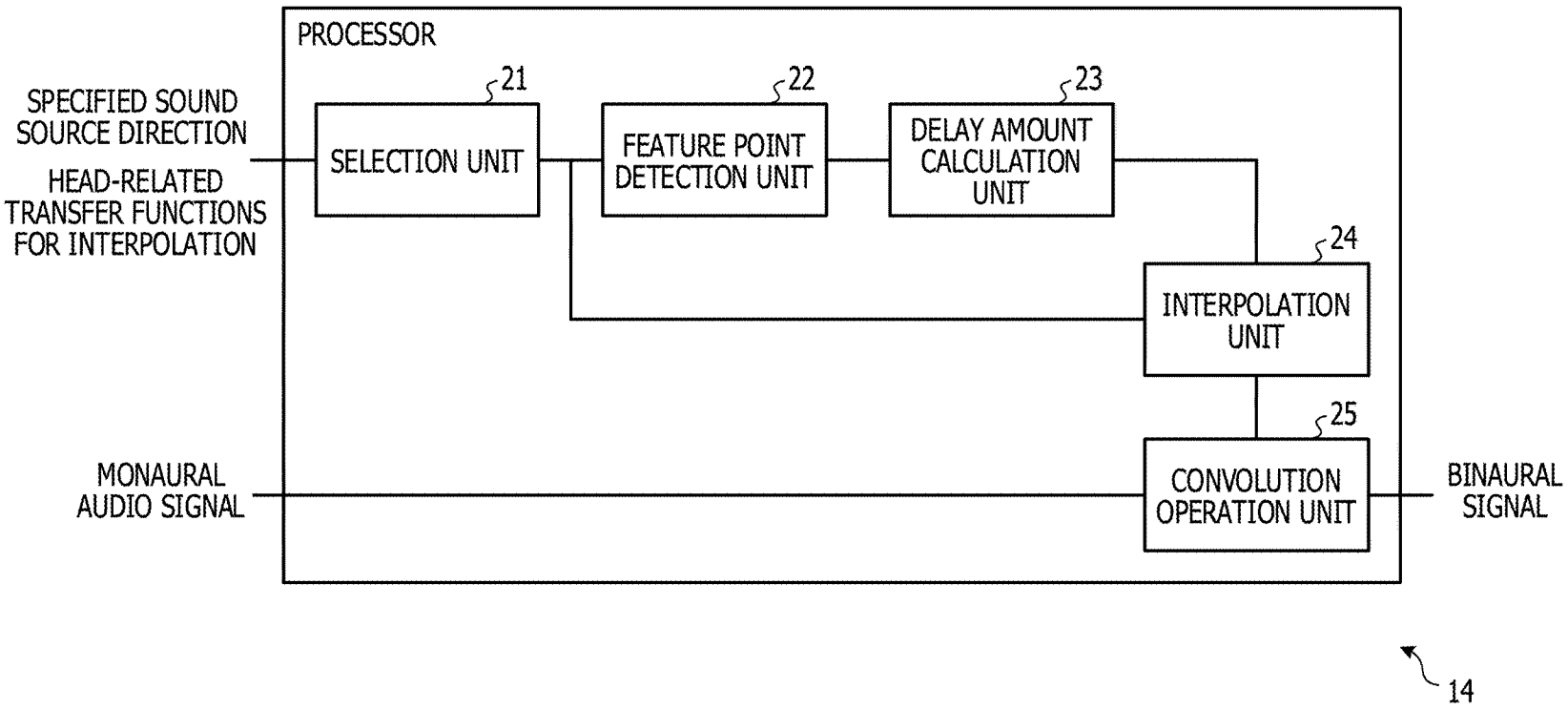
FIG. 2 is a functional block diagram of a processor in the audio processing apparatus for audio processing.

FIG. 2 is a functional block diagram of the processor 14 for audio processing. The processor 14 includes a selection unit 21, a feature point detection unit 22, a delay amount calculation unit 23, an interpolation unit 24, and a convolution operation unit 25.

These respective units included in the processor 14 are functional modules realized by computer programs running on the processor 14, for example. Alternatively, the respective units included in the processor 14 may have their functions built into the processor 14 as dedicated circuits.

The processing for generating the binaural signal for the left ear of the user and the processing for generating the binaural signal for the right ear of the user are different only in the head-related transfer function to be used, and processing details thereof are the same. Therefore, description is given below of the processing for one of the left and right ears, unless otherwise specified.

The selection unit 21 specifies two sound source directions sequentially from the one closest to the specified sound source direction among the plurality of sound source directions of the head-related transfer functions stored in the storage device 12. It is assumed, for example, that the storage device 12 stores head-related transfer functions for every 30° (for example, with the front direction of the user being 0°, 30°, 60°, 90°, . . . , and 330° clockwise as seen from above the user). When the specified sound source direction is 45°, the head-related transfer function for 30° and the head-related transfer function for 60° are specified. Then, the selection unit 21 reads the specified head-related transfer functions for the two sound source directions from the storage device 12, and hands over the read head-related transfer functions to the feature point detection unit 22 and the interpolation unit 24.

The feature point detection unit 22 detects a plurality of feature points from each of the two head-related transfer functions to be used for interpolation. For example, as for the head-related transfer function of interest, the feature point detection unit 22 detects any elapsed time when the head-related transfer function has a local maximum value, a local minimum value or a zero-cross point, as a feature point of the head-related transfer function. In this embodiment, for each of the head-related transfer functions, the feature point detection unit 22 detects the elapsed time when the head-related transfer function has the local maximum value, as the feature point.

Note that, as for the head-related transfer function, in general, the amplitude gradually decreases with the elapsed time. Therefore, the longer the elapsed time, the more ambiguous the local maximum value. As a result, an error in the elapsed time at which the local maximum value is reached is also increased as a consequence of a measurement error and the like. Therefore, the feature point detection unit 22 may detect a local maximum value having an absolute value of a predetermined amplitude threshold or more, among the local maximum values of the head-related transfer functions, as the feature point. In this case, the predetermined amplitude threshold may be set to, for example, the maximum value among the absolute values of extreme values of the head-related transfer functions targeted for feature point detection, that is, a value obtained by multiplying the maximum value of amplitude by 0.2 to 0.3.

The feature point detection unit 22 notifies the delay amount calculation unit 23 of the plurality of feature points detected for each of the head-related transfer functions.

For one of the two head-related transfer functions used for interpolation, the delay amount calculation unit 23 obtains a delay amount for the other at each elapsed time.

In this embodiment, for each of the plurality of feature points detected for one of the two head-related transfer functions used for interpolation, the delay amount calculation unit 23 first specifies a feature point corresponding thereto for the other head-related transfer function. Thus, the delay amount calculation unit 23 obtains pairs of feature points corresponding to each other for the two head-related transfer functions used for interpolation. Once the pairs of feature points are obtained, the delay amount calculation unit 23 calculates a delay amount of the feature point of one head-related transfer function relative to the feature point of the other head-related transfer function, for each pair of feature points. Then, for each elapsed time other than the feature points, the delay amount calculation unit 23 calculates a delay amount of one head-related transfer function relative to the other head-related transfer function at the elapsed time, based on the delay amount for the pair of feature points before and after the elapsed time.

For example, when the absolute value of a difference in value between two feature points of interest is a predetermined amplitude difference threshold or less and the absolute value of a time difference between the two feature points is a predetermined time difference threshold or less, the delay amount calculation unit 23 sets the two feature points as a pair of feature points corresponding to each other. The predetermined amplitude difference threshold may be obtained by multiplying the value at the feature point for one head-related transfer function by 0.1. Meanwhile, the predetermined time difference threshold is set based on the sampling frequency, an angular difference between the sound source directions corresponding to the two head-related transfer functions used for interpolation, a distance from the sound source to each ear of the user, and a distance between the left and right ears of the user. More specifically, based on the angular difference between the two sound source directions used for interpolation, the distance from the sound source to each ear of the user, and the distance between the left and right ears of the user, the maximum value of a difference in distance from the sound source to each ear of the user between the two sound source directions is calculated. The predetermined time difference threshold may be set so as to be a value obtained by adding an offset value to a time obtained by dividing the difference in distance by the speed of sound. It is assumed, for example, that a distance L from the sound source to the midpoint between the left and right ears of the user is 50 cm, a distance d between the left and right ears of the user is 16 cm, and an angular difference e between the sound source directions corresponding to the two head-related transfer functions is 30°. In this case, the maximum value of a difference diff between a distance l1 from the sound source to one of the ears of the user corresponding to one head-related transfer function and a distance l2 from the sound source to one of the ears of the user corresponding to the other head-related transfer function is approximately 4.1 cm. Therefore, 48000 [Hz]×4.1 [cm]/34000 [cm/sec (speed of sound)]≈6 is established when the sampling frequency is 48 kHz. Thus, considering the length of the ear canal, sound diffraction, and the like, the time difference threshold is set to the number of sampling points of 9 to 10.

Note that, in the case where zero-cross points are detected as the feature points, if the absolute value of a time difference between the feature point of one head-related transfer function and the feature point of the other head-related transfer function is the predetermined time difference threshold or less, the delay amount calculation unit 23 may set the two feature points as a pair of feature points corresponding to each other.

By obtaining pairs of feature points as described above, the delay amount calculation unit 23 enables feature points corresponding to each other between two head-related transfer functions to be accurately included in the same pair of feature points.

Figure 3:
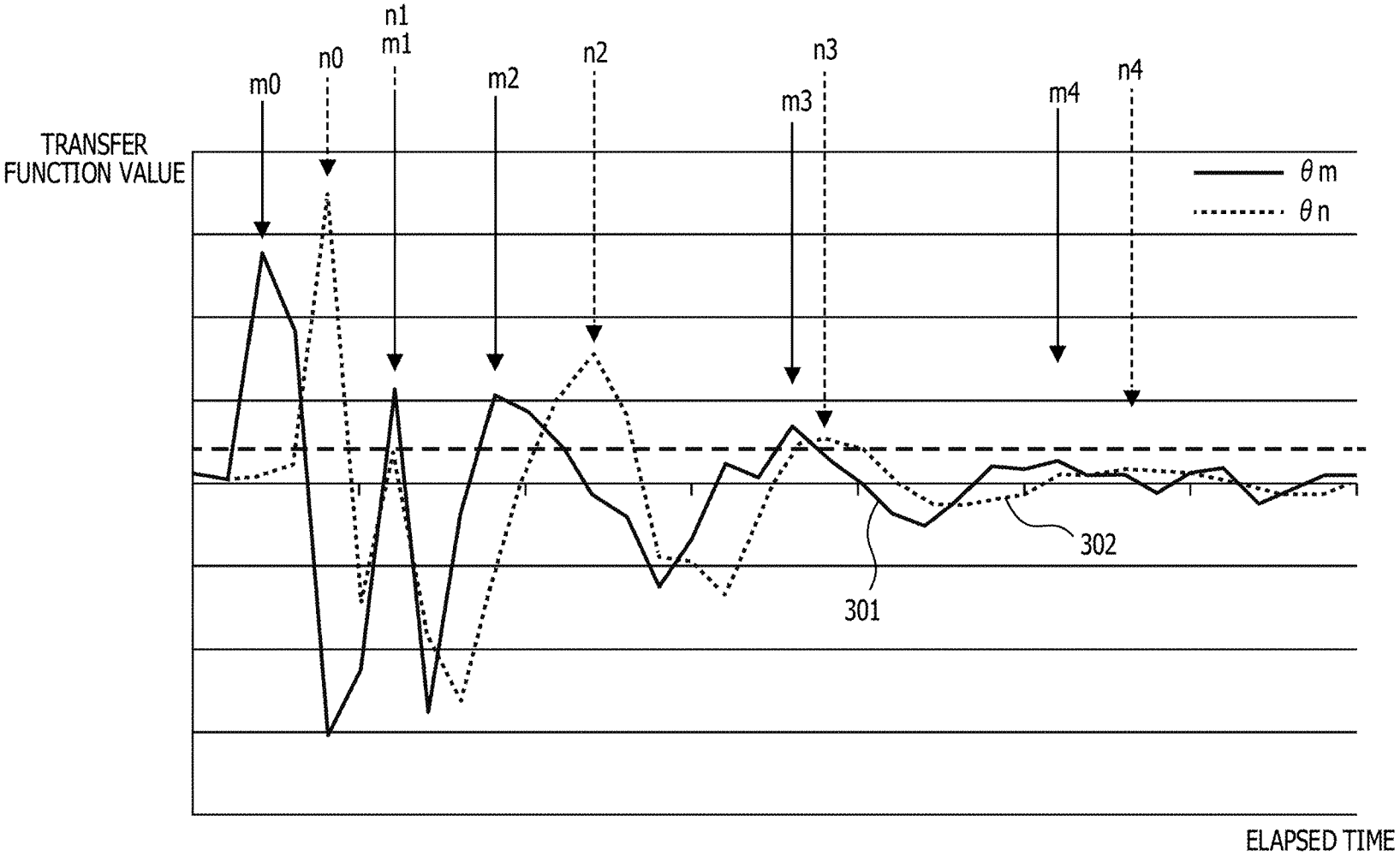
FIG. 3 is a diagram illustrating an example of pairs of corresponding feature points for two head-related transfer functions used for interpolation.

FIG. 3 is a diagram illustrating an example of pairs of corresponding feature points for two head-related transfer functions used for interpolation. In FIG. 3, the horizontal axis represents the elapsed time, while the vertical axis represents the value of the head-related transfer function. A waveform 301 illustrates one (sound source direction θm) of the two head-related transfer functions used for interpolation, while a waveform 302 illustrates the other one (sound source direction θn) of the two head-related transfer functions used for interpolation.

In this example, elapsed times $\{m_0, m_1, m_2, m_3, m_4\}$ corresponding to respective local maximum values in the head-related transfer function 301 are detected as feature points, respectively. Likewise, elapsed times $\{n_0, n_1, n_2, n_3, n_4\}$ corresponding to respective local maximum values in the head-related transfer function 302 are detected as feature points, respectively. Then, feature point pairs $\{m_0, n_0\}$, $\{m_1, n_1\}$, $\{m_2, n_2\}$, $\{m_3, n_3\}$, and $\{m_4, n_4\}$ are obtained, wherein the absolute value of a difference in value between the feature points is the amplitude difference threshold or less and the absolute value of a time difference between the feature points is the time difference threshold or less between the head-related transfer functions 301 and 302.

Note that, as in a modified example of the above example, when the local maximum values each having the absolute value of the predetermined amplitude threshold Th or more, among the respective local maximum values of the head-related transfer functions, are detected as the feature points, $\{m_0, n_0\}$, $\{m_1, n_1\}$, $\{m_2, n_2\}$, and $\{m_3, n_3\}$ are detected as the feature point pairs.

For each feature point pair, the delay amount calculation unit 23 calculates a delay amount of the feature point in one head-related transfer function relative to the feature point in the other head-related transfer function. Then, for each elapsed time other than the feature points, the delay amount calculation unit 23 calculates a delay amount of one head-related transfer function relative to the other head-related transfer function at the elapsed time, based on the delay amount for the pair of feature points before and after the elapsed time.

FIG. 4 is a diagram illustrating an example of a table illustrating the delay amount at each elapsed time, which is obtained from the feature point pairs illustrated in FIG. 3. In a table 400, each row of the leftmost column illustrates the elapsed time (number of the sampling point). The second column from the left illustrates the elapsed time for each feature point in the head-related transfer function 301, while the third column from the left illustrates the elapsed time of the feature point in the head-related transfer function 302, corresponding to each feature point in the head-related transfer function 301. Each row of the second column from the right in the table 400 illustrates the delay amount of the head-related transfer function 302 relative to the head-related transfer function 301. Note that, in the table 400, the delay amount is indicated by the number of sampling points.

In this example, the delay amount of the feature point $n_0$ (elapsed time T=10) relative to the feature point $m_0$ (elapsed time T=4) in the feature point pair $\{m_0, n_0\}$ is 6. Also, the delay amount of the feature point $n_1$ (elapsed time T=15) relative to the feature point $m_1$ (elapsed time T=15) in the feature point pair $\{m_1, n_1\}$ is 0. Therefore, the delay amount of the head-related transfer function 302 relative to the head-related transfer function 301 at each of the elapsed times T=5 to 14 is calculated by linear interpolation based on the delay amount 6 at the elapsed time T=4 and the delay amount 0 at the elapsed time T=15. Likewise, the delay amount at each elapsed time between the feature point pair $\{m_i, n_i\}$ (i=1, 2, 3) and the feature point pair $\{m_{i+1}, n_{i+1}\}$ is calculated by linear interpolation based on the delay amount in the feature point pair $\{m_i, n_i\}$ and the delay amount in the feature point pair $\{m_{i+1}, n_{i+1}\}$.

Note that the delay amount calculation unit 23 may set the delay amount for the elapsed time after the pair of feature points at which the elapsed time reaches its maximum to be the same as the delay amount in the pair of feature points at which the elapsed time reaches its maximum. Likewise, the delay amount calculation unit 23 may set the delay amount for the elapsed time before the pair of feature points at which the elapsed time reaches its minimum to be the same as the delay amount in the pair of feature points at which the elapsed time reaches its minimum.

According to a modified example, the delay amount calculation unit 23 may calculate the delay amount for each elapsed time by non-linear interpolation (for example, spline interpolation) using the delay amounts of three or more feature point pairs.

By calculating the delay amount based on pairs of feature points corresponding to each other between two head-related transfer functions as described above, the delay amount calculation unit 23 may accurately calculate a delay amount of one of the two head-related transfer functions relative to the other.

The delay amount calculation unit 23 notifies the interpolation unit 24 of the delay amount at each elapsed time.

The interpolation unit 24 generates a head-related transfer function for the specified sound source direction. For this purpose, for each of the elapsed times, the interpolation unit 24 specifies a value of one of the head-related transfer functions used for interpolation at the relevant elapsed time, and also specifies a value of the other head-related transfer function delayed from the relevant elapsed time by a corresponding delay amount. Then, the interpolation unit 24 obtains the value of the head-related transfer function in the specified sound source direction at the relevant elapsed time by interpolating the specified values of the two head-related transfer functions, for each elapsed time, based on angular differences between the specified sound source direction and the two sound source directions used for interpolation.

In this embodiment, the interpolation unit 24 may calculate the value of the head-related transfer function for the specified sound source direction at each elapsed time $t_i$ (i=0, 1, 2, . . . , N wherein N is the number of the sampling point corresponding to the maximum value of the elapsed time at which the value of the head-related transfer function is obtained) according to the following equations.

$$A(\theta_j, t_i) = \alpha \times A(\theta_m, t_i) + \beta \times A(\theta_n, t_i + \Delta t_i) \tag{1}$$

$$\alpha = \left|\frac{\theta_n - \theta_j}{\theta_n - \theta_m}\right|, \ \beta = \left|\frac{\theta_j - \theta_m}{\theta_n - \theta_m}\right|$$

Here, $\theta_j$ represents the specified sound source direction, and $\theta_m$ and $\theta_n$ represent sound source directions corresponding to the two head-related transfer functions used for interpolation, respectively. Also, $A(\theta_m, t_i)$ represents a value of the head-related transfer function for the sound source direction $\theta_m$ at the elapsed time $t_i$. In addition, $\Delta t_i$ represents a delay amount of the head-related transfer function for the sound source direction $\theta_n$ relative to the head-related transfer function for the sound source direction $\theta_m$ at the elapsed time $t_i$. Moreover, $A(\theta_n, t_i+\Delta t_i)$ represents a value of the head-related transfer function for the sound source direction $\theta_n$ at the elapsed time $(t_i+\Delta t_i)$. Furthermore, α and β are weight coefficients corresponding to the angular differences between the specified sound source direction and the sound source directions corresponding to the two head-related transfer functions used for interpolation. As is clear from the equations (1), the respective weight coefficients α and β are calculated such that the weight coefficient of one of the two head-related transfer functions used for interpolation, corresponding to the sound source direction closer to the specified sound source direction, is larger than that of the other head-related transfer function. $A(\theta_j, t_i)$ represents the value of the head-related transfer function for the specified sound source direction $\theta_j$ at the elapsed time $t_i$.

Figure 5A:
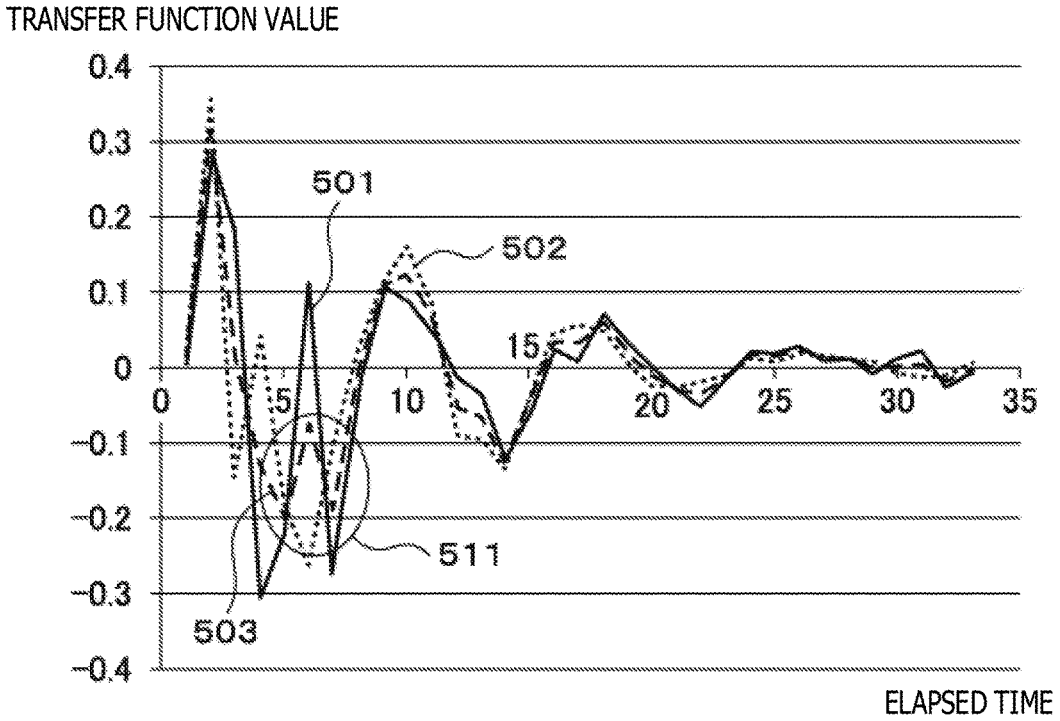
FIG. 5A is a diagram illustrating an example of head-related transfer functions calculated according to a conventional technique as a comparative example.
Figure 5B:
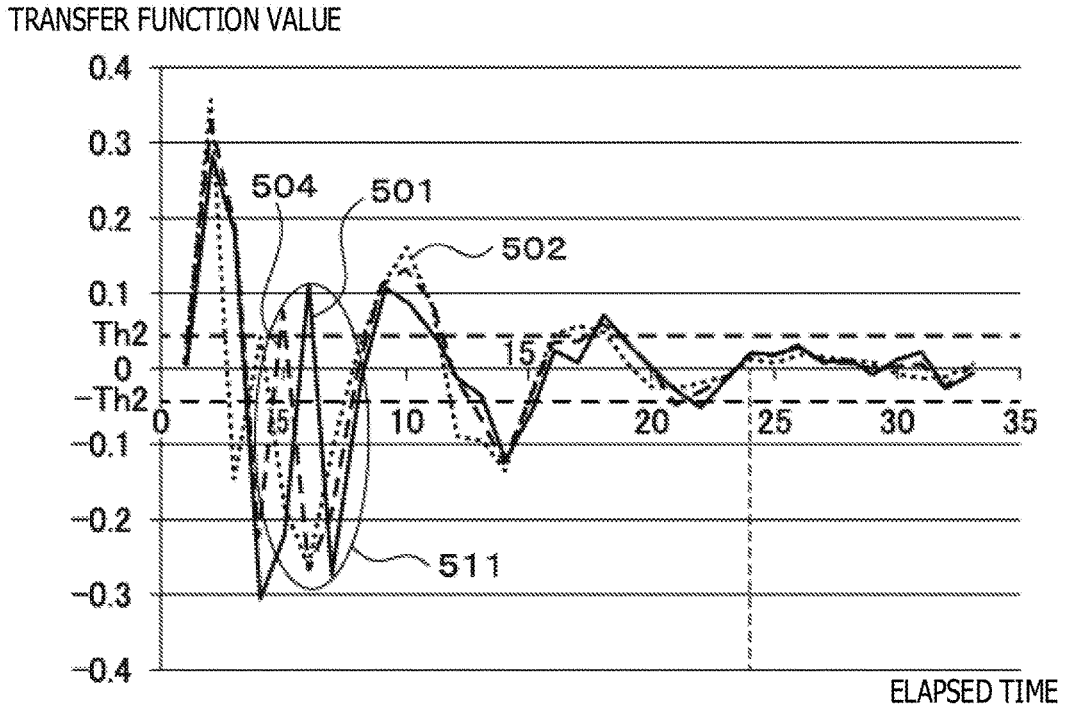
FIG. 5B is a diagram illustrating an example of head-related transfer functions calculated according to this embodiment.

FIG. 5A illustrates an example of head-related transfer functions calculated according to the conventional technique described in Patent Document 1. FIG. 5B illustrates an example of head-related transfer functions calculated according to this embodiment. In FIGS. 5A and 5B, the horizontal axis represents the elapsed time, while the vertical axis represents the value of the head-related transfer function. A waveform 501 illustrates one (sound source direction 120°) of the two head-related transfer functions used for interpolation, while a waveform 502 illustrates the other one (sound source direction 150°) of the two head-related transfer functions used for interpolation. A waveform 503 illustrates the head-related transfer function (sound source direction 135°) calculated according to the conventional technique. A waveform 504 illustrates the head-related transfer function (sound source direction 135°) calculated according to this embodiment.

In the head-related transfer function 503 calculated according to the conventional technique, a value smaller than the original value is obtained at a point 511 by the head-related transfer functions 501 and 502 canceling each other out. As a result, the head-related transfer function 503 may no longer accurately express transfer characteristics of the head of the user. In the head-related transfer function 504 calculated according to this embodiment, on the other hand, an appropriate value is obtained at the point 511.

Figure 6A:
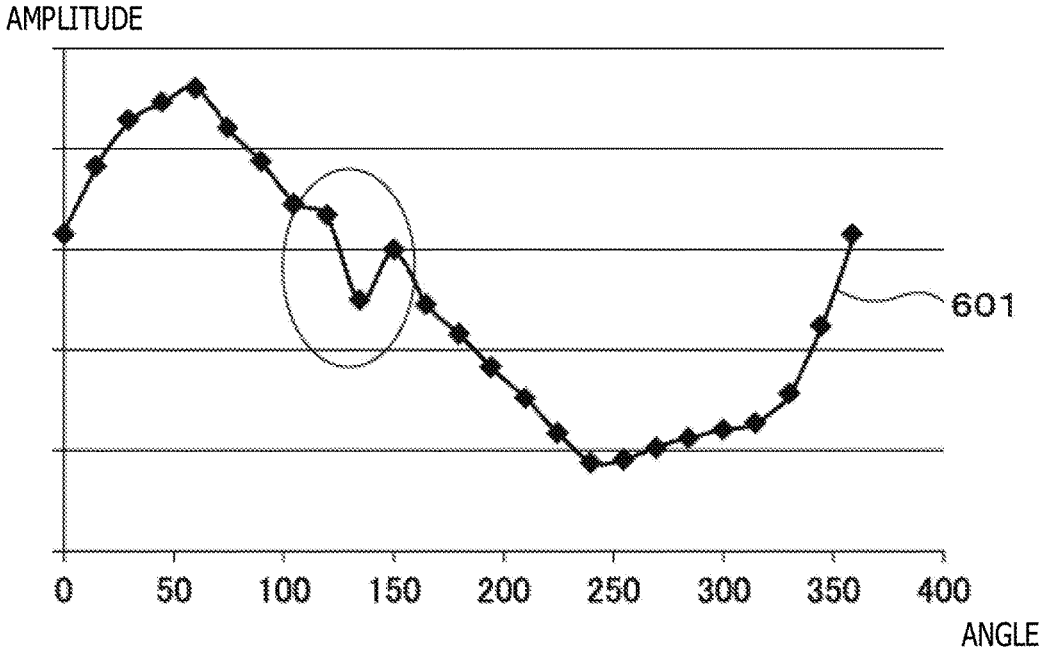
FIG. 6A is a diagram illustrating an example of a relationship between a sound source direction and the amplitude of a sound reaching a user, when sound image localization is performed using the head-related transfer function calculated according to the conventional technique.
Figure 6B:
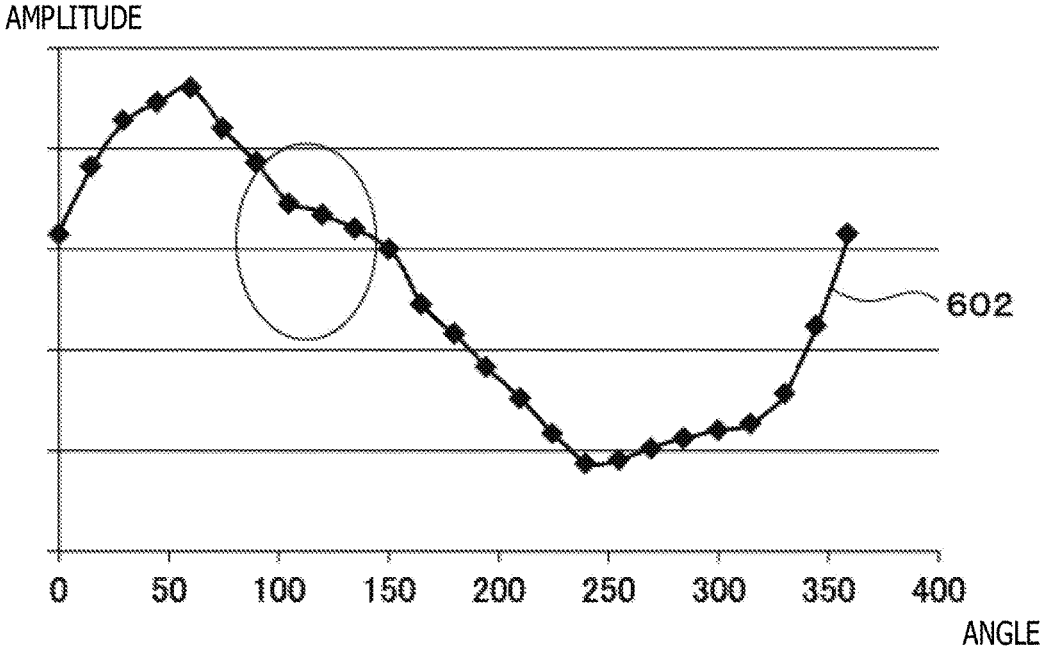
FIG. 6B is a diagram illustrating an example of a relationship between a sound source direction and the amplitude of a sound reaching the user, when sound image localization is performed using the head-related transfer function calculated according to this embodiment.

FIG. 6A is a diagram illustrating an example of a relationship between the sound source direction and the amplitude of a sound reaching the user, when sound image localization is performed using the head-related transfer function calculated according to the conventional technique when a virtual position of a sound source that generates white noise is moved to generate a binaural signal from each virtual position. FIG. 6B is a diagram illustrating an example of a relationship between the sound source direction and the amplitude of a sound reaching the user, when sound image localization is performed using the head-related transfer function calculated according to this embodiment when a virtual position of a sound source that generates white noise is moved to generate a binaural signal from each virtual position. In FIGS. 6A and 6B, the horizontal axis represents the sound source direction, while the vertical axis represents the amplitude of a sound. A waveform 601 illustrates a relationship between the sound source direction and the amplitude of the sound in the case of using the head-related transfer function calculated according to the conventional technique. A waveform 602 illustrates a relationship between the sound source direction and the amplitude of the sound in the case of using the head-related transfer function calculated according to this embodiment.

As illustrated by the waveform 601, the amplitude in the sound source direction of 135°, in the case of using the head-related transfer function calculated according to the conventional technique, is smaller than that in the adjacent sound source direction, and a change in amplitude for a change in sound source direction is discontinuous before and after 135°. On the other hand, as illustrated by the waveform 602, in the case of using the head-related transfer function calculated according to this embodiment, a change in amplitude for a change in sound source direction is continuous before and after 135°.

The selection unit 21, the feature point detection unit 22, the delay amount calculation unit 23, and the interpolation unit 24 perform the above processing for each of the left and right ears of the user to generate head-related transfer functions for the left and right ears, respectively, for the specified sound source direction. Then, the interpolation unit 24 outputs the head-related transfer functions for the left and right ears for the specified sound source direction to the convolution operation unit 25.

The convolution operation unit 25 reads a specified monaural audio signal from the storage device 12. Then, the convolution operation unit 25 performs a convolution operation of the monaural audio signal and the head-related transfer function for the left ear calculated for the specified sound source direction, thereby generating a binaural signal for the left ear for the specified sound source direction. Likewise, the convolution operation unit 25 performs a convolution operation of the monaural audio signal and the head-related transfer function for the right ear calculated for the specified sound source direction, thereby generating a binaural signal for the right ear for the specified sound source direction.

The convolution operation unit 25 stores the generated binaural signals for the left and right ears in the storage device 12. Alternatively, the convolution operation unit 25 may output the generated binaural signals for the left and right ears to a headphone, an earphone or a speaker through an audio interface (not illustrated). Alternatively, the convolution operation unit 25 may transmit the generated binaural signals for the left and right ears to another device through a communication interface (not illustrated).

Figure 7:
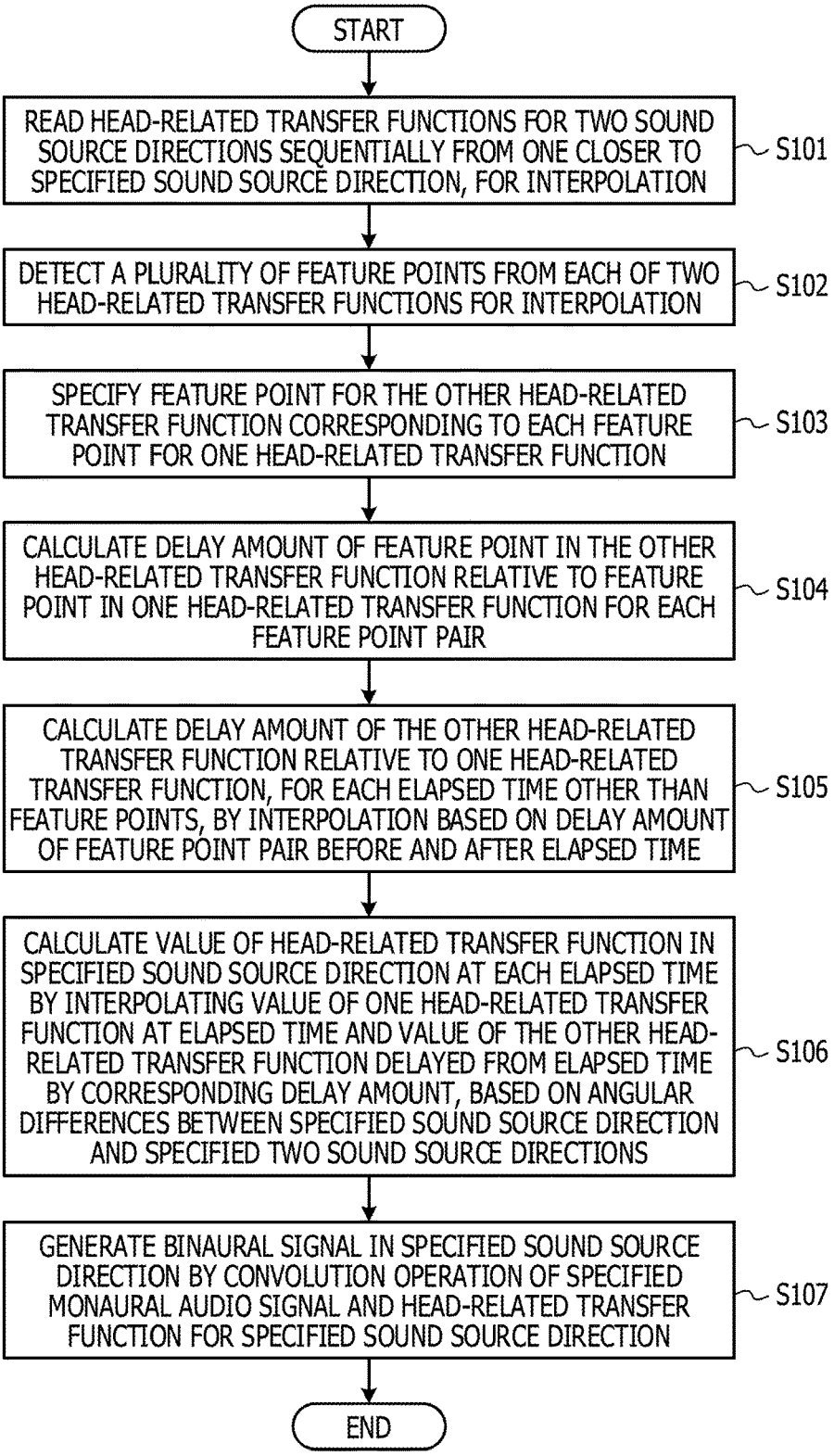
FIG. 7 is an operation flowchart of audio processing.

FIG. 7 is an operation flowchart of audio processing. The audio processing apparatus 1 may execute audio processing according to the following operation flowchart every time a sound source direction is specified for each of the left and right ears of the user.

The selection unit 21 specifies two sound source directions sequentially from the one closest to the specified sound source direction among a plurality of sound source directions of head-related transfer functions stored in the storage device 12. Then, the selection unit 21 reads head-related transfer functions for the specified two sound source directions from the storage device 12 as head-related transfer functions to be used for interpolation (Step S101).

The feature point detection unit 22 detects a plurality of feature points from each of the two head-related transfer functions to be used for interpolation (Step S102). For each of the plurality of feature points detected for one of the two head-related transfer functions to be used for interpolation, the delay amount calculation unit 23 specifies a corresponding feature point for the other head-related transfer function (Step S103). Then, for each feature point pair, the delay amount calculation unit 23 calculates a delay amount of the feature point for one head-related transfer function relative to the feature point for the other head-related transfer function (Step S104). Thereafter, for each elapsed time other than the feature points, the delay amount calculation unit 23 calculates a delay amount of one head-related transfer function relative to the other head-related transfer function at the elapsed time by interpolation based on the delay amount for the pair of feature points before and after the elapsed time (Step S105).

For each of the elapsed times, the interpolation unit 24 specifies a value of one of the two head-related transfer functions used for interpolation at the relevant elapsed time, and also specifies a value of the other head-related transfer function delayed from the relevant elapsed time by a corresponding delay amount. Then, the interpolation unit 24 calculates the value of the head-related transfer function in the specified sound source direction at the relevant elapsed time by interpolating the specified values of the two head-related transfer functions, for each elapsed time, based on angular differences between the specified sound source direction and the respective sound source directions specified for interpolation (Step S106). Thus, the head-related transfer function for the specified sound source direction is generated.

The convolution operation unit 25 performs a convolution operation of the specified monaural audio signal and the head-related transfer function calculated for the specified sound source direction, thereby generating a binaural signal for the specified sound source direction (Step S107). Thereafter, the processor 14 terminates the audio processing.

As described above, the audio processing apparatus generates a head-related transfer function for a specified sound source direction by interpolation using head-related transfer functions for two different sound source directions. In this event, the audio processing apparatus obtains a delay amount of one of the two head-related transfer functions used for interpolation relative to the other, for each elapsed time. For each elapsed time, the audio processing apparatus specifies a value of one of the two head-related transfer functions at the relevant elapsed time, and also specifies a value of the other head-related transfer function delayed from the relevant elapsed time by a corresponding delay amount. Then, the audio processing apparatus obtains the value of the head-related transfer function in the specified sound source direction at the relevant elapsed time by interpolating the specified values of the two head-related transfer functions, for each elapsed time, based on angular differences between the specified sound source direction and the two sound source directions used for interpolation. Thus, the audio processing apparatus may properly generate the head-related transfer function for the specified sound source direction.

Note that, according to a modified example, for each pair of feature points corresponding to each other for the two head-related transfer functions used for interpolation, the delay amount calculation unit 23 may obtain a midpoint between one feature point and the other feature point included in the pair, as a reference time. Then, for each pair of feature points corresponding to each other, the delay amount calculation unit 23 may obtain a delay amount of each of the two head-related transfer functions for the reference time. In this case, a delay amount of one of the head-related transfer functions relative to the other is expressed by a value obtained by subtracting the delay amount of one of the head-related transfer functions for the reference time from the delay amount of the other head-related transfer function for the reference time. Note that, since one of the head-related transfer functions is before the reference time, the delay amount for that head-related transfer function takes a negative value.

Figure 8:
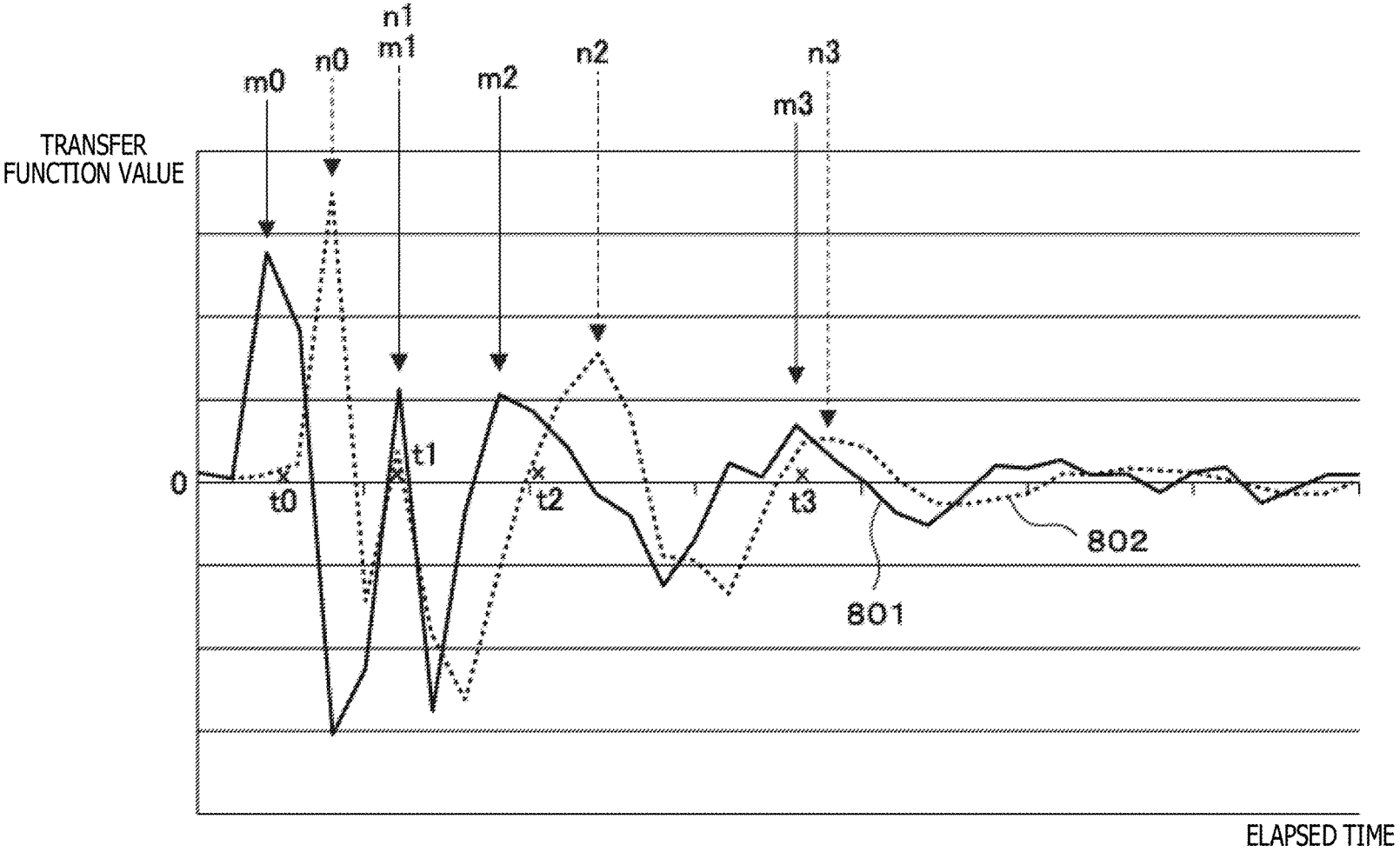
FIG. 8 is a diagram illustrating an example of a relationship between a feature point pair and a reference time of delay amount calculation for two head-related transfer functions used for interpolation.

FIG. 8 is a diagram illustrating an example of a relationship between a feature point pair and a reference time of delay amount calculation for the two head-related transfer functions used for interpolation. In FIG. 8, the horizontal axis represents the elapsed time, while the vertical axis represents the value of the head-related transfer function. A waveform 801 illustrates one (sound source direction θm) of the two head-related transfer functions used for interpolation, while a waveform 802 illustrates the other one (sound source direction θn) of the two head-related transfer functions used for interpolation.

In this example, elapsed times $\{m_0, m_1, m_2, m_3\}$ corresponding to respective local maximum values in the head-related transfer function 801 are detected as feature points, respectively. Likewise, elapsed times $\{n_0, n_1, n_2, n_3\}$ corresponding to respective local maximum values in the head-related transfer function 802 are detected as feature points, respectively. Then, $\{m_0, n_0\}$, $\{m_1, n_1\}$, $\{m_2, n_2\}$, and $\{m_3, n_3\}$ are obtained as feature point pairs between the head-related transfer functions 801 and 802. In this case, a midpoint $t_0$ $(=(m_0+n_0)/2)$ between $m_0$ and $n_0$ is the reference time for the feature point pair $\{m_0, n_0\}$. Likewise, a midpoint $t_i$ $(=(m_i+n_i)/2)$ between $m_i$ and $n_i$ is the reference time for the feature point pair $\{m_i, n_i\}$ (i=1, 2, 3).

FIG. 9 is a diagram illustrating an example of a table illustrating the delay amount at each elapsed time, which is obtained from the feature point pairs illustrated in FIG. 8. In a table 900, each row of the leftmost column illustrates the elapsed time (number of the sampling point). The second column from the left illustrates the elapsed time for each feature point in the head-related transfer function 801, while the third column from the left illustrates the elapsed time of the feature point in the head-related transfer function 802, corresponding to each feature point in the head-related transfer function 801. Furthermore, the fourth column from the left illustrates the reference time for each feature point pair. Each row of the third column from the right in the table 900 illustrates the delay amount of the head-related transfer function 801 for the reference time at each elapsed time. Likewise, each row of the second column from the right in the table 900 illustrates the delay amount of the head-related transfer function 802 for the reference time at each elapsed time. Note that, in the table 900, the delay amount is indicated by the number of sampling points.

In this example, the reference time $t_0$ for the feature point pair $\{m_0 (=4), n_0 (=10)\}$ is 7. Therefore, the delay amount of the head-related transfer function 801 for the reference time $t_0$ is '−3', while the delay amount of the head-related transfer function 802 for the reference time $t_0$ is '3'. Likewise, the reference time $t_1$ for the feature point pair $\{m_1 (=15), n_1 (=15)\}$ is 15. Therefore, the delay amount of the head-related transfer function 801 and the delay amount of the head-related transfer function 802 for the reference time $t_1$ are both '0'. Also, the reference time $t_2$ for the feature point pair $\{m_2 (=20), n_2 (=28)\}$ is 24. Therefore, the delay amount of the head-related transfer function 801 for the reference time $t_2$ is '−4', while the delay amount of the head-related transfer function 802 for the reference time $t_2$ is '4'. For the head-related transfer function 801, a delay amount at each elapsed time between two continuous feature points may be calculated by linear interpolation based on the delay amount at each of the two feature points. Likewise, for the head-related transfer function 802, a delay amount at each elapsed time between two continuous feature points may be calculated by linear interpolation based on the delay amount at each of the two feature points.

In this modified example, again, the delay amount calculation unit 23 may set the delay amount for the elapsed time after the pair of feature points at which the elapsed time reaches its maximum to be the same as the delay amount in the pair of feature points at which the elapsed time reaches its maximum. Likewise, the delay amount calculation unit 23 may set the delay amount for the elapsed time before the pair of feature points at which the elapsed time reaches its minimum to be the same as the delay amount in the pair of feature points at which the elapsed time reaches its minimum.

Moreover, the delay amount calculation unit 23 may calculate the delay amount for each elapsed time by non-linear interpolation (for example, spline interpolation) using the delay amounts of three or more feature point pairs.

In this modified example, the interpolation unit 24 may calculate the value A ($\theta_j$, $t_i$) of the head-related transfer function for the specified sound source direction $\theta_j$ at each elapsed time $t_i$ (i=0, 1, 2, . . . , N wherein N is the number of the sampling point corresponding to the maximum value of the elapsed time at which the value of the head-related transfer function is obtained) according to the following equations.

$$A(\theta_j, t_i) = \alpha \times A(\theta_m, t_i + \Delta t_{mi}) + \beta \times A(\theta_n, t_i + \Delta t_{ni}) \quad (2)$$

$$\alpha = \left|\frac{\theta_n - \theta_j}{\theta_n - \theta_m}\right|, \beta = \left|\frac{\theta_j - \theta_m}{\theta_n - \theta_m}\right|$$

Here, $\Delta t_m$, represents a delay amount of the head-related transfer function for the sound source direction $\theta_m$ relative to the reference time at the elapsed time $t_i$. Likewise, $\Delta t_{ni}$ represents a delay amount of the head-related transfer function for the sound source direction $\theta_n$ relative to the reference time at the elapsed time $t_i$.

According to this modified example, the delay amount calculation unit 23 enables the delay amount to change more smoothly with a change in elapsed time. Thus, the audio processing apparatus according to this modified example may suppress the value of the head-related transfer function in the specified sound source direction from changing more rapidly than normal with a change in elapsed time.

According to another modified example, the feature point detection unit 22 may detect two or more kinds of feature points from two head-related transfer functions used for interpolation, respectively. For example, the feature point detection unit 22 may detect two or more of maximum points, minimum points, and zero-cross points, as feature points, from the two head-related transfer functions. In this case, again, the delay amount calculation unit 23 obtains a plurality of pairs of feature points corresponding to each other between the two head-related transfer functions. Then, the delay amount calculation unit 23 may calculate the delay amount of one of the head-related transfer function relative to the other, for each feature point pair. Alternatively, the delay amount calculation unit 23 may obtain a midpoint between two feature points included in a feature point pair for each pair, as a reference time, and then calculate a delay amount of each of the two head-related transfer functions relative to the reference time. In either case, for each elapsed time other than the feature points, the delay amount calculation unit 23 may calculate the delay amount for each of the head-related transfer functions by interpolation based on the delay amount at feature points before and after the elapsed time.

Moreover, in general, the longer the elapsed time, the more the head-related transfer function is attenuated. Therefore, the longer the elapsed time, the smaller the amplitude of the head-related transfer function. For this reason, the feature points of the head-related transfer function become ambiguous. Therefore, the regularity for the delay amount of one of the two head-related transfer functions used for interpolation relative to the other is lost. As a result, the value often becomes approximately zero as the elapsed time gets longer in the head-related transfer function obtained by interpolating the two head-related transfer functions according to the above embodiment or the modified example.

Therefore, according to another modified example, the interpolation unit 24 may emphasize a portion, of the head-related transfer function in the specified sound source direction obtained by interpolation, after an elapsed time at which the amplitude reaches a predetermined limit threshold or less, by multiplying the value of the head-related transfer function by a predetermined emphasizing coefficient (for example, 1.5 to 2). For example, when a predetermined number or more of absolute values of extreme values consecutively reach the predetermined limit threshold or less in the head-related transfer function in the specified sound source direction, the interpolation unit 24 may set the elapsed time corresponding to the first extreme value of those consecutive extreme values as the elapsed time at which the amplitude reaches the predetermined limit threshold or less. Note that the predetermined limit threshold may be obtained by averaging the absolute values of local maximum values and local minimum values in the head-related transfer function, for example. It is also preferable that the predetermined limit threshold is set to a value smaller than a predetermined amplitude threshold used to detect the local maximum value or the local minimum value as the feature point.

Referring again to FIG. 5B, for example, a portion of the head-related transfer function 504 at and after the time t1 where the amplitude reaches a limit threshold Th2 or less may be emphasized.

According to this modified example, the interpolation unit 24 may suppress the head-related transfer function generated by interpolation from being excessively attenuated even when the elapsed time gets longer.

Note that, in this modified example, the interpolation unit 24 may perform the emphasizing process by multiplying the value of the head-related transfer function by a predetermined emphasizing coefficient at each elapsed time when the absolute value of the value of the head-related transfer function in the specified sound source direction reaches the predetermined limit threshold or less. Alternatively, the processing by the interpolation unit 24 may be performed after the above processing is performed to emphasize a portion having the amplitude attenuated to some extent or more for each of the two head-related transfer functions used for interpolation, instead of emphasizing the head-related transfer function generated by interpolation.

According to still another modified example, for a plurality of head-related transfer functions pre-stored in the storage device 12, the angular difference between sound source directions does not have to be an equal angle interval.

Figure 10:
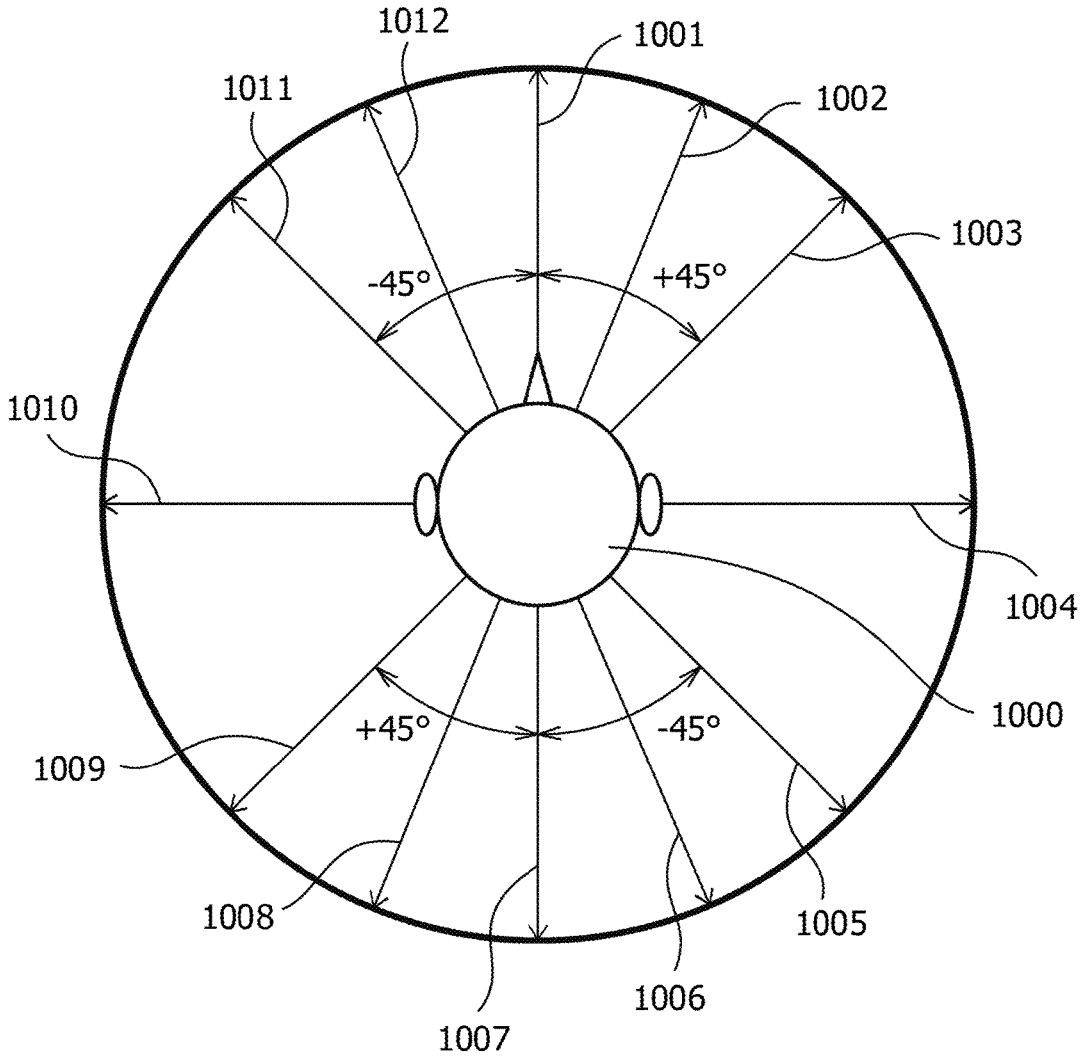
FIG. 10 is a diagram illustrating an example of sound source directions corresponding to a plurality of pre-stored head-related transfer functions, respectively.

FIG. 10 is a diagram illustrating an example of sound source directions corresponding to pre-stored head-related transfer functions, respectively. In FIG. 10, arrows 1001 to 1012 indicate the sound source directions corresponding to the pre-stored head-related transfer functions. In this example, an angular difference between the sound source directions corresponding to the pre-stored head-related transfer functions is relatively small within ±45° range in front of and behind a user 1000 where the auditory sensitivity of the user 1000 is relatively high. On the other hand, the angular difference between the sound source directions corresponding to the pre-stored head-related transfer functions is relatively large within ±45° range to the left and right of the user 1000 where the auditory sensitivity of the user 1000 is relatively low. Therefore, when a specified sound source direction is included in the ±45° range in front of and behind a user 1000 where the auditory sensitivity of the user 1000 is relatively high, the angular difference is reduced between the sound source directions of the two head-related transfer functions used for interpolation. Thus, the audio processing apparatus may generate more accurate head-related transfer functions. The audio processing apparatus may also suppress the number of the pre-stored head-related transfer functions.

According to still another modified example, a plurality of feature points may be previously detected for each of a plurality of pre-stored head-related transfer functions. Also, the detected feature points may be pre-stored in the storage device 12 together with the head-related transfer functions corresponding thereto. According to this modified example, the feature point detection unit 22 may be omitted. Therefore, computational complexity for audio processing is reduced.

A computer program causing a computer to realize the respective functions of the processor in the audio processing apparatus according to the above embodiment or modified examples may be provided in a recorded state in a computer-readable medium such as a magnetic recording medium or an optical recording medium.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. An audio processing method comprising:

executing a delay amount acquisition process that includes acquiring, for each of a plurality of elapsed times, a delay amount of a second head-related transfer function relative to a first head-related transfer function, the first head-related transfer function indicating sound transfer characteristics in a head of a user for a first sound source direction, the second head-related transfer function indicating sound transfer characteristics in the head of the user for a second sound source direction;

executing an interpolation process that includes calculating, for each of the plurality of elapsed times, a value of a third head-related transfer function at the elapsed time, by interpolating a first value and a second value based on a first angular difference and a second angular difference, the third head-related transfer function indicating sound transfer characteristics in the head of the user for a third sound source direction, the first value being a value of the first head-related transfer function at the elapsed time, the second value being a value of the second head-related transfer function at a time delayed from the elapsed time by a delay amount corresponding to the elapsed time, the first angular difference being an angular difference between the third sound source direction and the first sound source direction, the second angular difference being an angular difference between the third sound source direction and the second sound source direction; and localizing a sound source at the third sound source direction by processing an audio signal utilizing the third head-related transfer function.

2. The audio processing method according to claim 1, further comprising:

executing a first detection process that includes detecting a plurality of pairs of feature points corresponding between the first head-related transfer function and the second head-related transfer function, wherein the delay amount acquisition process is configured to calculate, for each of the plurality of pairs of feature points, a delay amount of the feature point of the second head-related transfer function relative to the feature point of the first head-related transfer function included in the pair.

3. The audio processing method according to claim 1, further comprising:

executing a first detection process that includes detecting a plurality of pairs of feature points corresponding between the first head-related transfer function and the second head-related transfer function, each of the plurality of pairs of feature points including a first feature point regarding the first head-related transfer function and a second feature point regarding the second head-related transfer function, wherein the delay amount acquisition process is configured to calculate, for each of the plurality of pairs of feature points, a first delay amount and a second delay amount relative to a midpoint between the first feature point and the second feature point included in the pair, the first delay amount being a delay amount of the first feature point relative to the midpoint, the second delay amount being a delay amount of the second feature point relative to the midpoint.

4. The audio processing method according to claim 1, further comprising:

executing an emphasizing process that includes emphasizing a portion of the third head-related transfer function after an elapsed time at which an amplitude reaches a predetermined limit threshold or less in the third head-related transfer function.

5. An audio processing apparatus, comprising:

a memory; and a processor coupled to the memory and configured to execute a delay amount acquisition process that includes acquiring, for each of a plurality of elapsed times, a delay amount of a second head-related transfer function relative to a first head-related transfer function, the first head-related transfer function indicating sound transfer characteristics in a head of a user for a first sound source direction, the second head-related transfer function indicating sound transfer characteristics in the head of the user for a second sound source direction, execute an interpolation process that includes calculating, for each of the plurality of elapsed times, a value of a third head-related transfer function at the elapsed time, by interpolating a first value and a second value based on a first angular difference and a second angular difference, the third head-related transfer function indicating sound transfer characteristics in the head of the user for a third sound source direction, the a first value being a value of the first head-related transfer function at the elapsed time, the second value being a value of the second head-related transfer function at a time delayed from the elapsed time by a delay amount corresponding to the elapsed time, the first angular difference being an angular difference between the third sound source direction and the first sound source direction, the second angular difference being an angular difference between the third sound source direction and the second sound source direction, and localizing a sound source at the third sound source direction by processing an audio signal utilizing the third head-related transfer function.

6. The audio processing apparatus according to claim 5, wherein the processor is further configured to:

execute a first detection process that includes detecting a plurality of pairs of feature points corresponding between the first head-related transfer function and the second head-related transfer function, wherein the delay amount acquisition process is configured to calculate, for each of the plurality of pairs of feature points, a delay amount of the feature point of the second head-related transfer function relative to the feature point of the first head-related transfer function included in the pair.

7. The audio processing apparatus according to claim 5, wherein the processor is further configured to:

execute a first detection process that includes detecting a plurality of pairs of feature points corresponding between the first head-related transfer function and the second head-related transfer function, each of the plurality of pairs of feature points including a first feature point regarding the first head-related transfer function and a second feature point regarding the second head-related transfer function, wherein the delay amount acquisition process is configured to calculate, for each of the plurality of pairs of feature points, a first delay amount and a second delay amount relative to a midpoint between the first feature point and the second feature point included in the pair, the first delay amount being a delay amount of the first feature point relative to the midpoint, the second delay amount being a delay amount of the second feature point relative to the midpoint.

8. The audio processing apparatus according to claim 5, wherein the processor is further configured to:

execute an emphasizing process that includes emphasizing a portion of the third head-related transfer function after an elapsed time at which an amplitude reaches a predetermined limit threshold or less in the third head-related transfer function.

9. A non-transitory computer-readable storage medium for storing a audio processing computer program, the audio processing computer program causing a processor to perform processing, the processing comprising:

executing a delay amount acquisition process that includes acquiring, for each of a plurality of elapsed times, a delay amount of a second head-related transfer function relative to a first head-related transfer function, the first head-related transfer function indicating sound transfer characteristics in a head of a user for a first sound source direction, the second head-related transfer function indicating sound transfer characteristics in the head of the user for a second sound source direction;

executing an interpolation process that includes calculating, for each of the plurality of elapsed times, a value of a third head-related transfer function at the elapsed time, by interpolating a first value and a second value based on a first angular difference and a second angular difference, the third head-related transfer function indicating sound transfer characteristics in the head of the user for a third sound source direction, the a first value being a value of the first head-related transfer function at the elapsed time, the second value being a value of the second head-related transfer function at a time delayed from the elapsed time by a delay amount corresponding to the elapsed time, the first angular difference being an angular difference between the third sound source direction and the first sound source direction, the second angular difference being an angular difference between the third sound source direction and the second sound source direction; and localizing a sound source at the third sound source direction by processing an audio signal utilizing the third head-related transfer function.

10. The non-transitory computer-readable storage medium according to claim 9, the processing further comprising:

executing a first detection process that includes detecting a plurality of pairs of feature points corresponding between the first head-related transfer function and the second head-related transfer function, wherein the delay amount acquisition process is configured to calculate, for each of the plurality of pairs of feature points, a delay amount of the feature point of the second head-related transfer function relative to the feature point of the first head-related transfer function included in the pair.

11. The non-transitory computer-readable storage medium according to claim 9, the processing further comprising:

executing a first detection process that includes detecting a plurality of pairs of feature points corresponding between the first head-related transfer function and the second head-related transfer function, each of the plurality of pairs of feature points including a first feature point regarding the first head-related transfer function and a second feature point regarding the second head-related transfer function, wherein the delay amount acquisition process is configured to calculate, for each of the plurality of pairs of feature points, a first delay amount and a second delay amount relative to a midpoint between the first feature point and the second feature point included in the pair, the first delay amount being a delay amount of the first feature point relative to the midpoint, the second delay amount being a delay amount of the second feature point relative to the midpoint.

12. The non-transitory computer-readable storage medium according to claim 9, the processing further comprising:

executing an emphasizing process that includes emphasizing a portion of the third head-related transfer function after an elapsed time at which an amplitude reaches a predetermined limit threshold or less in the third head-related transfer function.

* * * * *